US006289676B1

(12) United States Patent
Prociw et al.

(10) Patent No.: US 6,289,676 B1
(45) Date of Patent: Sep. 18, 2001

(54) SIMPLEX AND DUPLEX INJECTOR HAVING PRIMARY AND SECONDARY ANNULAR LUD CHANNELS AND PRIMARY AND SECONDARY LUD NOZZLES

(75) Inventors: Lev Alexander Prociw, Elmira; Harris Shafique, Longueuil; Parthasarathy Sampath, Mississauga, all of (CA)

(73) Assignee: Pratt & Whitney Canada Corp., Longueuil (CA)

( * ) Notice: Subject to any disclaimer, the term of this patent is extended or adjusted under 35 U.S.C. 154(b) by 0 days.

(21) Appl. No.: 09/337,348

(22) Filed: Jun. 21, 1999

(30) Foreign Application Priority Data

Jun. 26, 1998 (CA) ..... 2241674

(51) Int. Cl.[7] ..... F02G 1/00
(52) U.S. Cl. ..... 60/740
(58) Field of Search ..... 60/748, 743, 742, 60/739; 239/399, 406, 405, 404

(56) References Cited

U.S. PATENT DOCUMENTS 1,654,381 12/1927 Murphy et al. .
1,875,457 9/1932 Hemmingsen .
2,690,648 10/1954 Pearce et al. .

(List continued on next page.)

FOREIGN PATENT DOCUMENTS 1264777 10/1961 (FR) .
493434 11/1938 (GB) .

*Primary Examiner*—Timothy S. Thorpe
*Assistant Examiner*—William H Rodriquez
(74) *Attorney, Agent, or Firm*—Jeffrey W. Astle

(57) ABSTRACT

A fuel injector for a combustor presented either as a simplex or duplex pressurized fuel injector, wherein the fuel is introduced into the injector to provide a swirl to the fuel in a first annular channel which communicates with a coaxial conical fuel swirl chamber and then the primary nozzle. In a duplex version, a secondary annular swirl channel is provided for spinning the fuel and communicating downstream with a conical fuel swirl chamber and eventually an annular nozzle whereby the fuel is atomized as it exits the nozzle. An air swirler is also provided with the fuel injector, and the air swirler includes air passages arranged in an annular array about the fuel injector tip. A second array of auxiliary air passages can be arranged spaced radially from the first array and also to provide an air swirl and to control the spray cone of the fuel air mixture.

12 Claims, 5 Drawing Sheets

U.S. PATENT DOCUMENTS

| | | | | |
|---|---|---|---|---|
| 2,968,925 | | 1/1961 | Blevans et al. . | |
| 3,076,607 | | 2/1963 | Cordier . | |
| 3,129,891 | | 4/1964 | Vdoviak . | |
| 3,302,399 | | 2/1967 | Tini et al. . | |
| 3,483,700 | | 12/1969 | Ryberg et al. . | |
| 3,516,252 | | 6/1970 | Udell et al. . | |
| 3,684,186 | | 8/1972 | Helmrich . | |
| 3,735,930 | | 5/1973 | Mori . | |
| 3,886,736 | | 6/1975 | Kawaguchi . | |
| 3,912,164 | | 10/1975 | Lefebvre et al. . | |
| 4,028,888 | | 6/1977 | Pilarcy . | |
| 4,170,108 | | 10/1979 | Mobsby . | |
| 4,216,652 | * | 8/1980 | Herman et al. | 60/748 |
| 4,258,544 | | 3/1981 | Gebhart et al. . | |
| 4,362,022 | | 12/1982 | Faucher et al. . | |
| 4,467,610 | | 8/1984 | Pearson et al. . | |
| 4,491,272 | | 1/1985 | Bradley et al. . | |
| 4,689,961 | | 9/1987 | Stratton . | |
| 4,763,481 | | 8/1988 | Cannon . | |
| 4,854,127 | | 8/1989 | Vinson et al. . | |
| 4,890,453 | | 1/1990 | Iwai et al. . | |
| 4,970,865 | | 11/1990 | Shekelton et al. . | |
| 4,974,416 | | 12/1990 | Taylor . | |
| 5,031,401 | | 7/1991 | Hinderks . | |
| 5,115,634 | | 5/1992 | Bretz et al. . | |
| 5,127,346 | | 7/1992 | Kepplinger et al. . | |
| 5,161,379 | | 11/1992 | Jones et al. . | |
| 5,222,357 | | 6/1993 | Eddy et al. . | |
| 5,288,021 | | 2/1994 | Sood et al. . | |
| 5,351,489 | | 10/1994 | Okamoto et al. . | |
| 5,423,178 | | 6/1995 | Mains . | |
| 5,570,580 | | 11/1996 | Mains . | |
| 5,577,386 | | 11/1996 | Alary et al. . | |
| 5,579,645 | * | 12/1996 | Prociw et al. | 60/740 |
| 5,865,024 | | 2/1999 | Kress et al. . | |
| 6,101,814 | * | 8/2000 | Hoke et al. | 60/752 |

* cited by examiner

SIMPLEX AND DUPLEX INJECTOR HAVING PRIMARY AND SECONDARY ANNULAR LUD CHANNELS AND PRIMARY AND SECONDARY LUD NOZZLES

BACKGROUND OF THE INVENTION

1. Field of the Invention

The present invention relates to gas turbine engines and, more particularly, to a fuel injector for such engines.

2. Description of the Prior Art

Many small gas turbine engines utilize fuel pressure to atomize fuel at the fuel nozzle of an injector to inject fuel into the combustion chamber. At low fuel flows, such as starting conditions, the fuel flow rate is too low to pressurize the fuel to produce adequate droplet size for a particular injector. Such fuel systems are designed for maximum pressure at full engine power. Thus, the smallest flow number possible for a given engine design is determined by the maximum pressure available from the fuel pump at maximum power. At starting conditions and low power, small quantities of fuel are required, thereby developing low pressure drop. This results in inadequate atomization at low power and leads to poor emissions and combustion instability.

Furthermore, since the fuel injector is immersed in a very hot environment of the gas turbine engine, stagnation of the fuel in the delivery passages can be detrimental to the injector in that the heat transfer from the walls of the injector is reduced which can lead to hot spots on the otherwise wetted wall. It has been found that excessive wall temperatures can lead to fuel coking and subsequent injector contamination. Low fuel flows in these regions further aggravate the situation.

In some cases, lack of adequate heat transfer in the stem may lead to unacceptable temperature gradients and attendant stresses in the stem which can affect its fatigue life.

It has been found that by swirling a substantial quantity of air around a nozzle of a fuel injector, an improvement in low power performance can be obtained. However, swirling the air can lead to flow separation around the face of the injector, resulting in carbon growth and overheating of the injector.

Air swirlers have been developed and are described in U.S. Pat. No. 5,579,645, Prociw et al, issued Dec. 3, 1996, and U.S. Pat. No. 6,082,113 for a Gas Turbine Injector by Prociw et al and assigned to Pratt & Whitney Canada Inc. The above-mentioned U.S. Pat. No. 5,579,645 and U.S. Pat. No. 6,082,113 is incorporated herein by reference. These air swirlers reduce flow separation at the injector. However, it is considered that other improvements are required to improve low power performance of the injector by improving fuel atomization at the injector.

The stem of the injector, that is, the elongated stem through which the various fuel conduits are contained, extends from the fuel source across the P3 air envelope surrounding the combustor wall. The stem is also subjected to high temperatures and, therefore, problems of fuel stagnation that can lead to fuel coking is also possible within the stem.

SUMMARY OF THE INVENTION

It is an aim of the present invention to provide an improved injector wherein low power fuel atomization will be enhanced.

It is a further aim of the present invention to provide an injector that incorporates the advantages of the air swirler as described in U.S. Pat. No. 6,082,113 with an improved fuel injector.

It is a further aim of the present invention to provide an improved simplex pressure injector with improved low power performance.

It is yet a further aim of the present invention to provide an improved duplex pressure injector with improved low power performance.

It is an aim of the present invention to provide a fuel flow path within the stem and the injector tip which follows a circular path. Parts of the stem and the injector tip are provided with annuli which allow a circular and/or spiral path for the fuel.

It is yet a further aim of the present invention to provide an improved fuel flow passage in the stem of the injector. It is known that the velocity of the flow in the annular channels is controlled by appropriately sizing the inlet orifice to produce the correct pressure loss for the heat transfer rate required. According to the present invention, much higher velocities than would occur in conventional designs are attributable to the present method since a large portion of the fuel flow is in the tangential direction and not governed by the mass of fuel.

In the present invention, this control of the flow velocity to produce the correct pressure loss is determined not by a single metering or trim orifice at the inlet to the injector but by providing such metering orifices throughout the stem prior to the fuel entering the injector.

A construction in accordance with the present invention comprises a fuel injector for a combustor in a gas turbine engine, wherein the combustor includes a combustor wall defining a combustion chamber surrounded by pressurized air, the injector comprising an injector tip adapted to protrude, when in use, through the combustor wall into the chamber, the injector tip having an injector body extending along an injector tip axis, a primary fuel nozzle formed in the injector tip concentrically of the injector tip axis and communicating with a primary fuel chamber formed as a cone upstream of the fuel nozzle and coaxial therewith, at least a first annular fuel channel defined in the injector body upstream of the primary fuel chamber concentric with the injector tip axis and communicating with the primary fuel chamber, and means for providing a flow of pressurized fuel to the first annular channel tangentially thereof in order to provide a swirl to the fuel flow in the first annular fuel channel, the primary fuel chamber and thus to the injector tip, thereby atomizing the fuel as it exits the primary fuel nozzle.

More particularly, swirl slots communicate the first annular channel to the primary fuel chamber.

In a more specific embodiment of the present invention, there is provided a secondary fuel delivery arrangement whereby a secondary annular fuel channel is provided concentrically and outwardly of the primary fuel channel, a secondary annular conical fuel swirl chamber is provided concentrically and outwardly of the primary swirl fuel chamber, and a secondary fuel nozzle is provided concentrically and outwardly of the primary fuel nozzle and the injector tip axis, means for providing a flow of pressurized fuel to the secondary annular channel tangential thereof in order to provide a swirl to the fuel flow in the secondary annular fuel channel, the secondary annular fuel channel communicating with the secondary fuel swirl chamber so as to provide a swirl to the fuel whereby the secondary fuel will exit the secondary fuel nozzle in an atomized fashion.

It has been found that when the tangential velocity of the swirling fuel increases as it progresses in the conical primary fuel chamber, external air is entrained back into the primary fuel chamber along the tip axis, resulting in the formation of a thin hollow spinning film of fuel in the primary fuel chamber. As the fuel exits from the nozzle, it forms a thin conical unstable film that breaks down into droplets.

It is a further feature of the present invention to provide the injector with an air swirl member defining first air passages forming an annular array communicating the pressurized air from outside the wall into the combustion chamber, the first air passage being concentric with the primary fuel nozzle and the tip axis whereby the first air passages are arranged to further atomize the fuel emanating from the primary fuel nozzle, and a set of second air passages arranged in annular array in the injector tip spaced radially outwardly from the first air passages whereby the second passages are arranged to shape the spray of the mixture of atomized fuel and air and to add supplemental air to the mixture.

In a further embodiment of an injector in accordance with the present invention including an injector tip that has annular fuel flow passages, there is a stem containing at least one fuel flow passage extending from a stem fuel inlet to a fuel delivery outlet, a first annular fuel flow cavity provided in the stem near the fuel stem inlet, an inlet conduit extending from the fuel stem inlet to the annular cavity, the inlet conduit being angled to provide a tangential flow direction to the fuel passing through the conduit to the annular cavity, an outlet conduit extending at an acute angle from the first annular cavity to receive the fuel therefrom in a tangential direction, a first linear fuel conduit extending from the outlet conduit and extending axially of the stem and communicating with an injector inlet conduit at the fuel delivery outlet, the injector inlet conduit being angled to direct the fuel flow to a first annular passage in the injector tip in a tangential direction to provide a swirl to the fuel flow entering the annular passage in the injector tip.

In a more specific embodiment of the present invention, there is provided a metering of the fuel flow in the various conduits in the stem where alternating fuel flow conduits have differing cross-sectional areas arranged to provide the proper velocity to the fuel flow and result in the pressure loss to enhance the heat transfer rate.

As can be seen, throughout the injector tip and the stem, care has been taken to ensure tangential injection into the annular passages, thus maximizing the angular momentum of the fuel flow into the annular channels. The kinetic energy in the flow is dissipated at the stem and injector walls enhancing the heat transfer of the passages.

The passage metering and the fuel swirl slots in the injector tip are designed to control injector temperature and to eliminate fuel stagnation wherever possible.

BRIEF DESCRIPTION OF THE DRAWINGS

Having thus generally described the nature of the invention, reference will now be made to the accompanying drawings, showing by way of illustration, a preferred embodiment thereof, and in which.

DESCRIPTION OF THE PREFERRED EMBODIMENTS

The present specification describes two embodiments of the present invention. The first embodiment shown in FIGS. 1 and 2 is a simplex injector while the second embodiment shown in FIG. 3 is a duplex injector.

Figure 2:
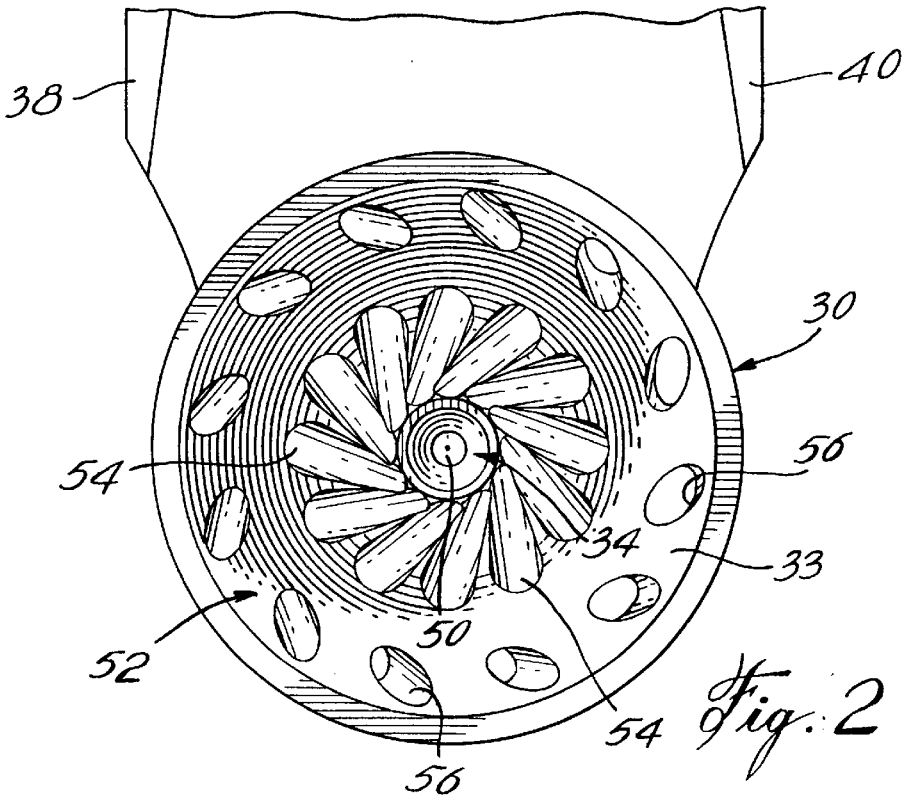
FIG. 2 is a front elevation of the injector in accordance with FIG. 1.
Figure 1:
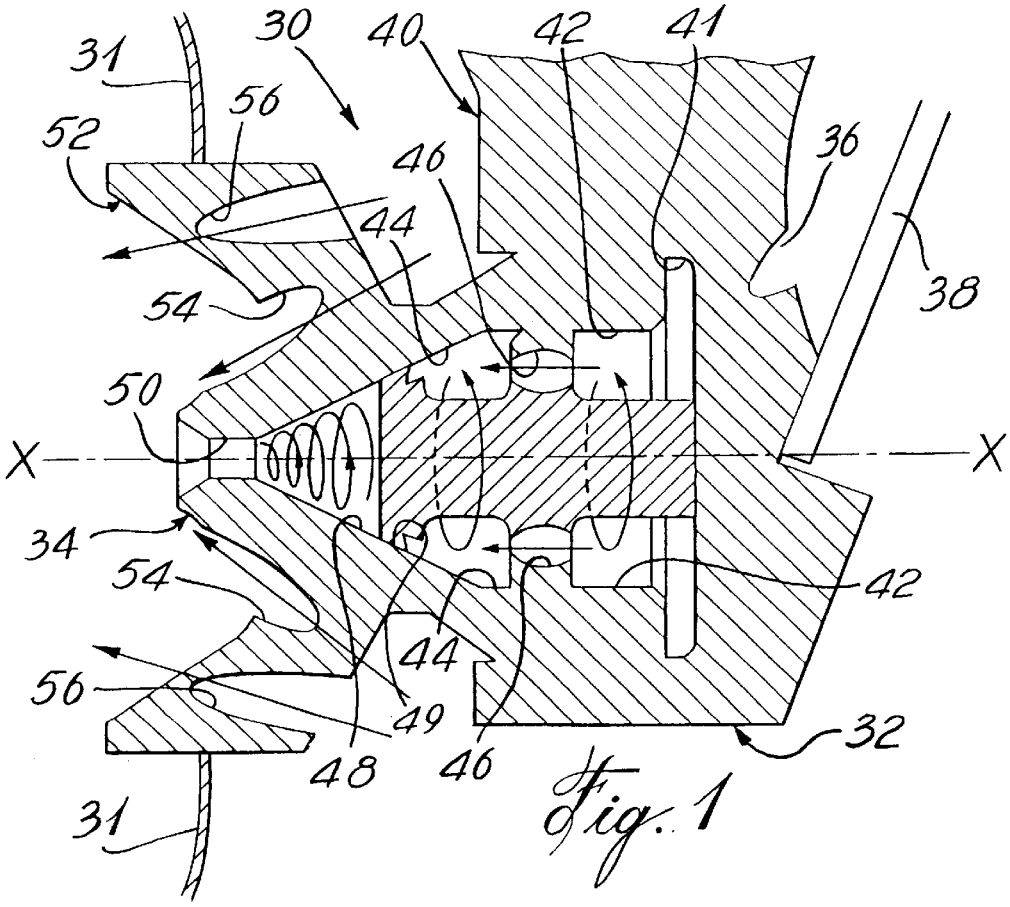
FIG. 1 is a fragmentary vertical cross-section of an injector in accordance with an embodiment of the present invention.
Figure 3:
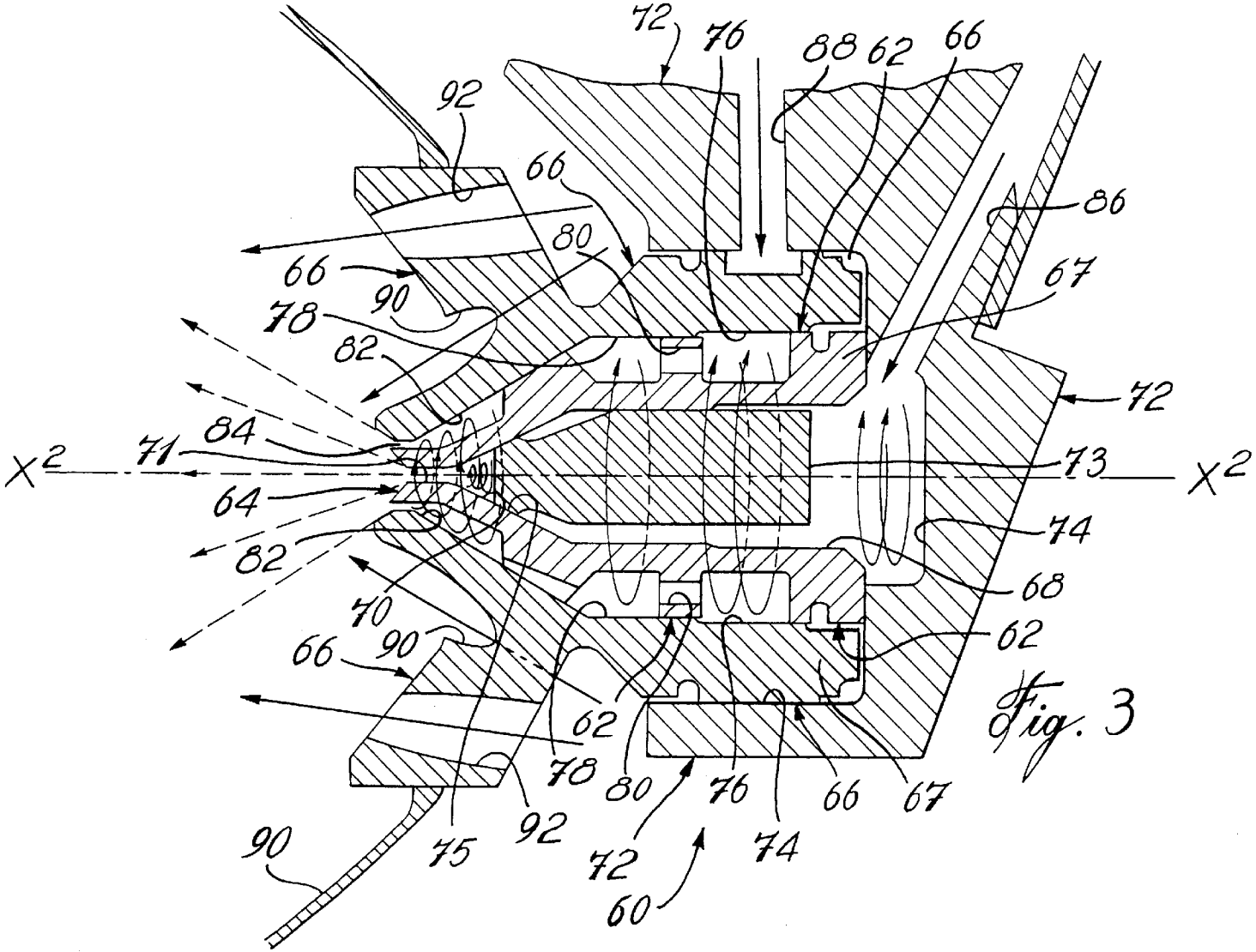
FIG. 3 is a fragmentary axial cross-section in accordance with another embodiment of the injector in accordance with the present invention.

Referring to the embodiment shown in FIGS. 1 and 2, the simplex injector is designated by the reference numeral 30. The injector 30 is shown mounted in an opening in the combustor wall 31. The injector 30 includes an injector body 32, an injector face 33, as shown in FIG. 2, and an injector tip 34.

A tip axis X extends through the tip 34 and the body 32, as shown in FIG. 1. A stem 40 is connected to the body 32, and at least a fuel passage 36 is formed in the stem 40 which is also covered by protective sleeve 38. The body 32 defines cavities, such as annular channels 41, 42, and 44, that are concentric to the tip axis X. The fuel line 36 communicates with the channel 41 in a somewhat tangential manner in order that the fuel under pressure will be provided a swirl in the annular channel 41. The annular channels 42 and 44 communicate with each other by means of slots 46 which are defined helically so as to provide a swirl or spin to the fuel as it passes from the annular channel 42 and to channel 44.

A conical fuel swirl chamber 48 is defined downstream of the channel 44, and slots 49 communicate the channel 44 to the chamber 48. As the diameter in the conical chamber 48 decreases, the velocity of the spinning fuel increases until it reaches the cylindrical nozzle 50. It is believed that the spinning fuel flow will create a film on the conical walls of the chamber 48 by centrifugal force, and external air may be drawn into the chamber to flow back along the tip axis X into the chamber 48. This separation effect results in a thin, hollow, spinning film which develops at the nozzle 50. As the fuel leaves the nozzle, it forms a thin conical sheet which stabilizes into droplets.

An annular air swirl member 52 is connected to the injector tip 34, as shown in FIGS. 1 and 2. The air swirl member 52 comprises a series of annular spaced-apart passages 54 distributed around the nozzle 50. As described in U.S. Pat. No. 6,082,113, the air flow from P3 air into the combustor passes through the holes or passages 54 in such a way as to avoid flow separation and to develop a conical fuel spray pattern within the combustor.

A second set of annularly spaced-apart passages 56 may be provided to shape the fuel air cone and to augment the combustion air into the combustor. Both sets of passages 54 and 56 are specifically sized to admit a predetermined quantity of air at the engine design point.

Referring now to the embodiment of FIG. 3, the duplex injector 60 is described which includes an injector body 62 and an injector tip 64. The tip axis $X^2$ passes through the injector tip 64 as shown.

The injector body 62 fits in a stem cavity 74. In this embodiment, the air swirl member 66 includes a cylindrical portion which has a greater diameter than the injector body 62.

The injector body 62 defines, with the cavity 74 of the stem 72, a primary fuel channel 68. The fuel channel 68 is annular because of the valve device 73 within the cavity so formed. The fuel annular channel 68 communicates with the primary fuel line 86 which is arranged to deliver the pressurized fuel tangentially of the channel 68 so as to create a fuel swirl within the primary fuel channel 68.

A primary fuel swirl chamber 70 is defined as a conical chamber downstream of the channel 68 and communicates with the nozzle 71. Slots 75 are defined between the valve 73 and the conical wall of the chamber 70. These slots are designed to enhance the spinning effect of the primary fuel from the primary fuel channel to the primary fuel chamber 70 and ultimately through the nozzle 71.

A secondary fuel channel 76 is formed between the injector body 62 and the cylindrical portion 67 of the air swirl member 66. Passages are provided in the cylindrical member 67 to communicate with the secondary fuel line 88 in the stem 72. The fuel line and the passages will provide a swirl to the secondary fuel as it enters the secondary annular channels 76. The annular channel 76 communicates with the downstream annular secondary fuel channel 78 by means of slots 80 which are designed to enhance the swirl of the secondary fuel. A conical secondary fuel chamber 82 is also provided which is annular to the axis $X^2$ and the primary fuel chamber 70. The secondary fuel chamber 82 has the same effect on the secondary swirling fuel as has the primary chamber 70. An annular nozzle 84 is also provided in order to allow the secondary fuel to form a conical spray with the primary fuel in the combustion chamber defined by combustor wall 94.

The air swirl member 66 is provided with air swirl passages 90 so as to focus the air flow from the P3 air into the combustion chamber just outside the fuel injector face. Auxiliary air passages 92 are also provided in the swirl component 66 and have a similar effect to those described with the simplex injector 30.

It is noted that another difference between the duplex injector 60 and the prior art is the absence of core air passages and the primary injector heat shield. The elimination of these elements reduces the manufacturing complexity as well as its cost. A duplex injector 60 is more compact for a given fuel flow rate. This injector does not have to be concerned with the heat transfer problems arising from the presence of core air in the interior passage of the injector. The integration of the air swirler component 66 with the fuel nozzles 71 and 84 helps reduce the overall size of the injector tip 64. The swirl component 66 design with the duplex injector 60 aids atomization particularly at low power when the fuel pressure in the secondary annular channel is too low to generate the thin film required for adequate atomization.

Figure 4:
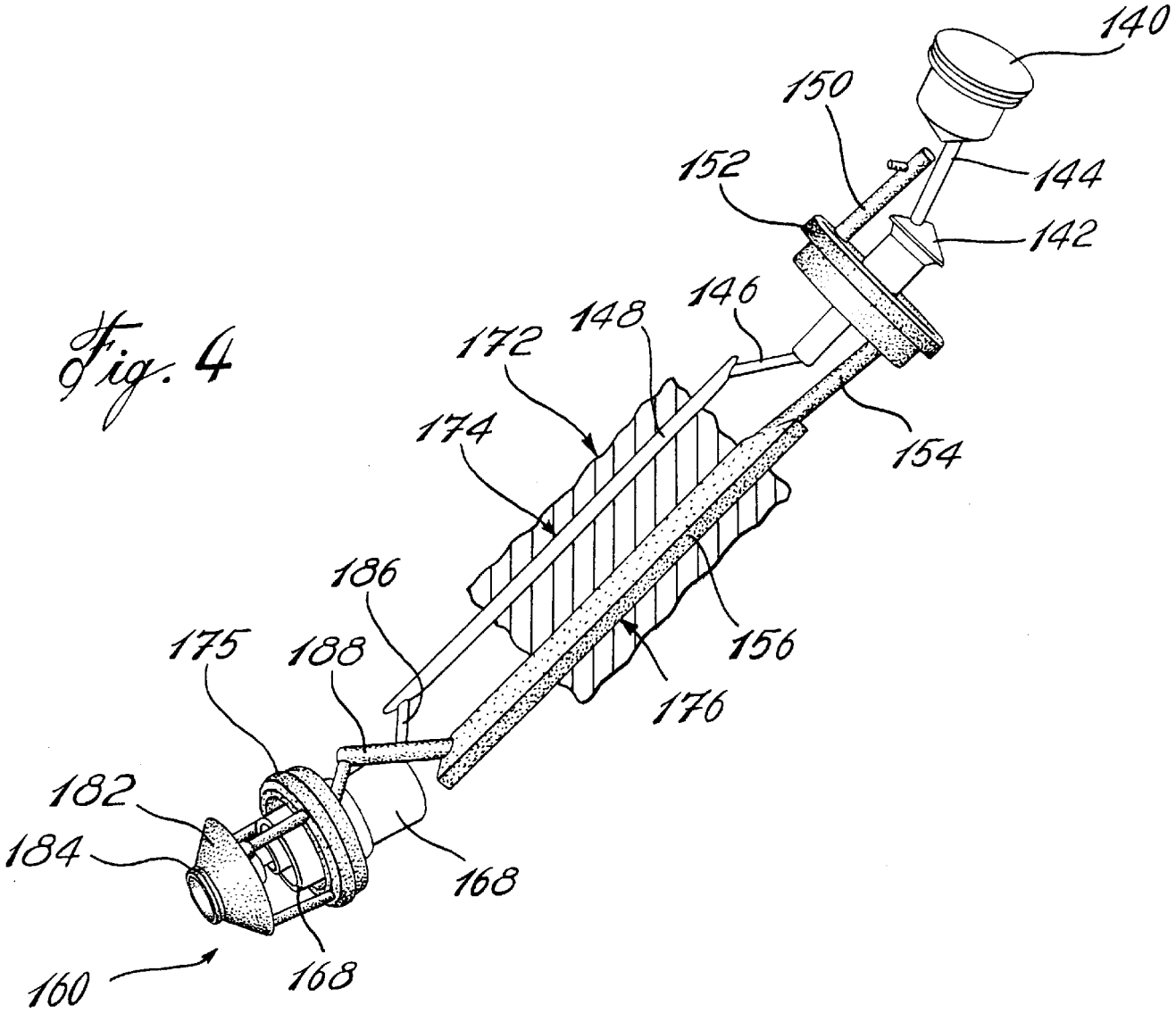
FIG. 4 is a perspective schematic view showing the flow passages of the injector in accordance with the present invention, including both the injector tip and the stem.

Referring now to FIG. 4, the stem 172 is shown generally in dotted lines. However, primary passage 174 and secondary passage 176 are illustrated in this drawing. The injector 160 is a duplex injector similar to that described in relation to FIG. 3. Thus, the injector tip 160 includes a primary fuel channel 168 and a secondary fuel channel 175.

The remote end of the stem is provided with a primary fuel inlet 140 which communicates with a circular cylindrical primary fuel chamber 142 by means of the inlet conduit 144. As noted in the drawings, the conduit 144 is angled so that it delivers the fuel in a tangential direction within the cylindrical primary fuel chamber 142. The primary fuel chamber 142 is shaped to allow the primary fuel to flow to swirl therein and exit through an outlet conduit 146 which is of somewhat smaller diameter than the chamber in order to provide a first metering passage. The conduit 146 communicates with a linear conduit 148 which has a larger cross-sectional area than the conduit 146.

The linear conduit 148 communicates with a delivery conduit 186 which is angled to deliver the primary fuel into the annular channel 168 tangentially. The delivery conduit 186 is also of a smaller cross-sectional area than the conduit 148 in order to meter the fuel flow into the channel 168.

The secondary fuel passage 175 of the stem 172 has a secondary fuel inlet conduit 150 which is angled to deliver the fuel to the annular channel 152 at the entry end of the stem 172. An outlet conduit 154 delivers the fuel flow from the annular channel 152 at a somewhat tangential angle to deliver the fuel to the linear conduit 156 which is of a larger cross-sectional area than the conduit 154. At the injector end of the stem, an angled two-part delivery conduit 188 is provided for delivering the fuel to the annular channel 175 in a tangential direction so as to provide a swirl to the fuel flow within the annular channel 175.

Figure 5:
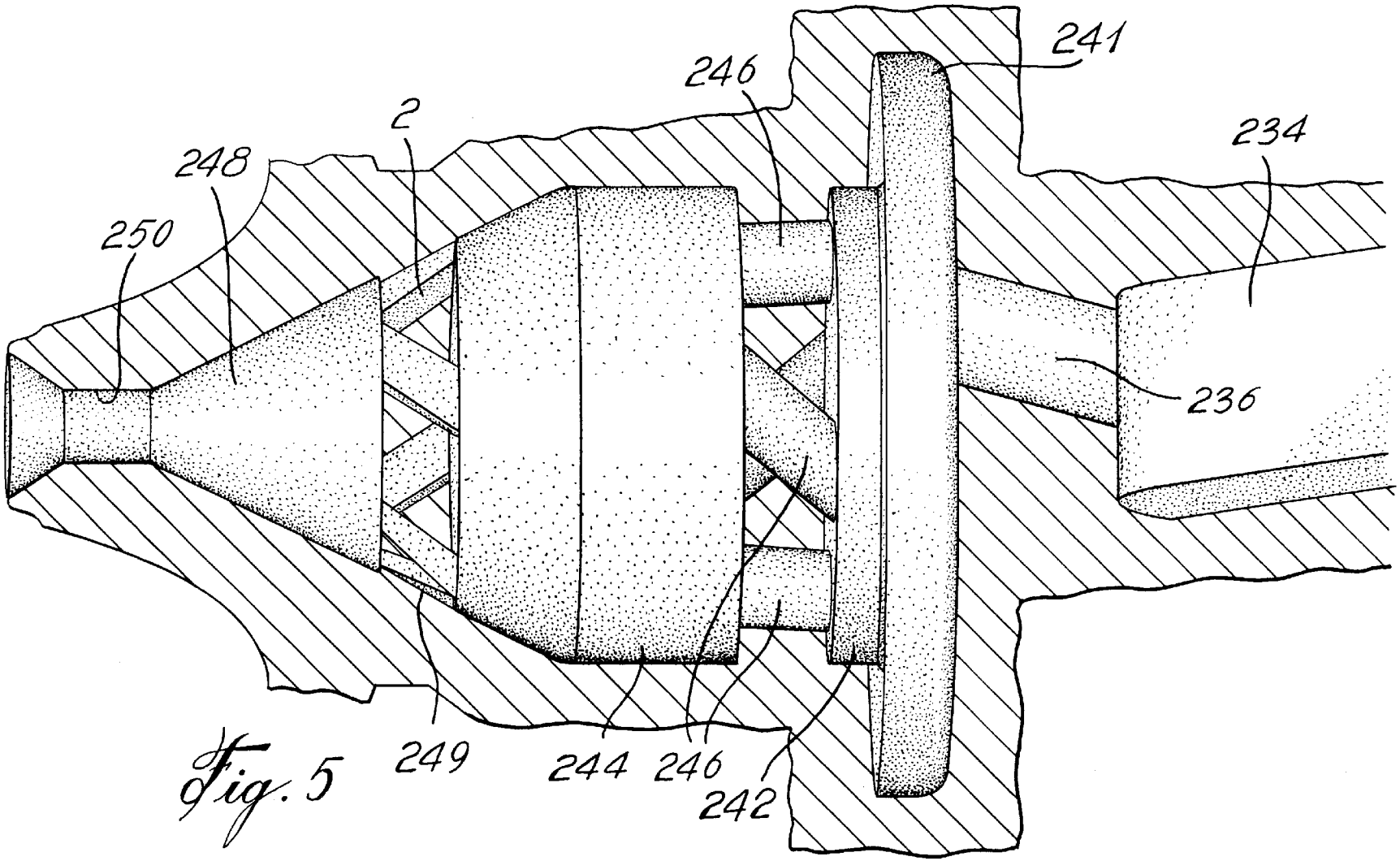
FIG. 5 is a schematic view showing the fuel passages within the injector tip of the embodiment shown somewhat in FIG. 1.
Figure 6:
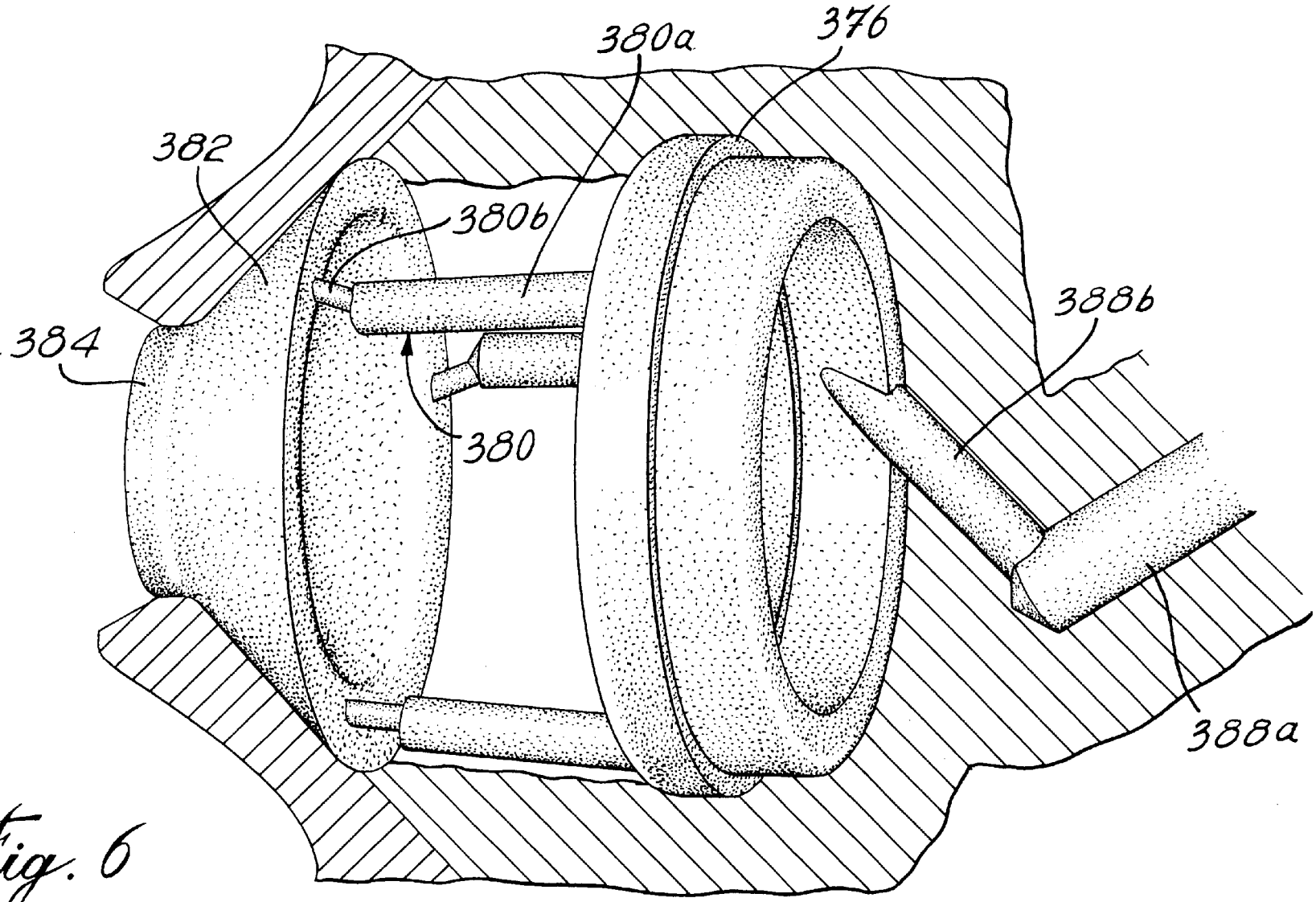
FIG. 6 is a perspective schematic view showing the flow passages based on the embodiment shown in FIG. 3 of the injector tip but showing only the secondary fuel flow passages.

FIGS. 5 and 6 correspond generally with the injector tip of FIG. 1, and although there are some constructional differences, they do resemble each other in principle.

Thus, the reference numerals used in FIG. 5 will correspond to the reference numerals used in FIG. 1 but have been raised by 200.

Thus, the fuel is delivered by means of the delivery conduit 236 into the annular channel 241. The slots 246 are all angled to deliver the fuel from the channels 241 and 242 into the annular channel 244. Angled slots 249 deliver the fuel tangentially to the chamber 248.

The schematic depiction of the fuel flow passages shown in FIG. 6 resembles the duplex injector shown in FIG. 3. The drawing represents the secondary fuel distribution in the injector tip (the primary flow is not shown) and that will now be described with similar reference numerals to those used in FIG. 3 but raised by 300.

Thus, the delivery conduit 388 is shown here with its two components 388*a* and 388*b*. As noted, the cross-sectional diameter of the conduit portion 388*a* is larger than the cross-sectional diameter of the portion 388*b*, thereby providing the metering effect mentioned previously in order to provide the proper pressure drop.

The delivery conduits 388*a* and 388*b* are so arranged in the stem that the portion 388*b* is directed tangentially to the annular channel 375 or 376. The so-called angular slots 380 are, in fact, as shown in FIG. 6, in two parts, one being a first outlet portion 380*a* delivering the fuel from the channel 376, and the second part 380*b* is of a smaller diameter and is angled to provide the fuel flow tangentially to the conical fuel swirl chamber 382.

We claim:

1. A fuel injector for use in a combustor of a gas turbine engine, whereby the combustor includes a combustor wall defining a combustion chamber surrounded by pressurized air, the injector comprising an injector tip adapted to protrude, when in use, through the combustor wall into the chamber, the injector tip having an injector body extending along an injector tip axis, a primary fuel nozzle formed in the injector tip concentrically of the injector tip axis and communicating with a primary fuel chamber formed as a cone upstream of the fuel nozzle and coaxial therewith, a first annular fuel channel defined in the injector body upstream of the primary fuel chamber concentric with the injector tip axis and communicating with the primary fuel chamber, a second annular fuel channel defined in the injector body upstream of the first annular fuel channel, passages communicating the second annular fuel channel downstream to the first annular fuel channel, and an inlet conduit defined in the injector body to communicate the fuel under pressure tangentially into the second fuel channel so as to provide a swirl to the fuel in the second fuel channel, and then to the first annular fuel channel tangentially thereof in order to provide a swirl to the fuel flow in the second annular fuel channel, the first annular fuel channel, the primary fuel chamber, and thus to the injector tip, thereby atomizing the fuel as it exits the primary fuel nozzle.

2. The fuel injector as defined in claim 1, wherein an annular air swirl member is provided mounted to the injector tip, the air swirl member including an annular array of first air passages communicating the pressurized air surrounding the combustor into the combustion chamber, the first air passages being concentric with the primary fuel nozzle and the tip axis whereby the first air passages are arranged to further atomize the fuel exiting from the primary fuel nozzle in order to enhance the atomization of the fuel exiting from the primary fuel nozzle and to provide a cone-shaped air and fuel spray within the combustion chamber.

3. The fuel injector as defined in claim 2, wherein a set of air passages is arranged in an annular array in the air swirl member spaced radially outwardly from the first air passages and concentric with the injector tip axis whereby the second passages are arranged to shape the spray of a mixture of atomized fuel and air and to add supplemental air to the mixture.

4. The fuel injector for a combustor as defined in claim 1, wherein the fuel injector is mounted to a stem containing at least one fuel flow passage extending from a stem fuel inlet to a fuel delivery outlet, a first annular fuel flow chamber provided in the stem near the fuel stem inlet, an inlet conduit extending from the fuel stem inlet to the first annular fuel chamber and being angled to provide a tangential flow direction to the fuel passing to the first annular fuel chamber, an outlet conduit extending at an acute angle from the first annular fuel chamber to receive the fuel therefrom in a tangential direction and deliver it to a linear fuel conduit extending axially of the stem and communicating with the inlet conduit.

5. The fuel injector as defined in claim 2, wherein the fuel injector body sits within a concentric cylindrical extension of the air swirl member.

6. In a fuel injector for use in a combustor of a gas turbine engine, wherein the fuel injector includes an injector tip having annular fuel flow passages, a stem containing at least one fuel flow passage extending from a stem fuel inlet to a stem fuel delivery outlet, a first annular fuel flow chamber provided in the stem near the fuel stem inlet, an inlet conduit extending from the fuel stem inlet to the first annular fuel flow chamber wherein the inlet conduit is angled to provide a tangential flow direction to the fuel passing through the conduit to the annular fuel flow chamber, an outlet conduit extending at an acute angle from the first annular fuel flow chamber to receive the fuel therefrom in a tangential direction, a first linear fuel conduit extending from the outlet conduit and extending axially of the stem and communicating with an injector inlet conduit at the fuel delivery outlet of the stem, the injector inlet conduit being angled to direct the fuel flow to a first annular passage in the injector in a tangential direction to provide a swirl to the fuel flow entering the annular passage in the injector tip.

7. In the injector as defined in claim 6, wherein the injector tip has a secondary annular fuel flow passage and the stem comprises a second annular fuel flow channel concentric with the fuel flow cavity, a second inlet conduit extends from the fuel stem inlet to the second annular channel and being angled to provide a tangential flow direction to the secondary fuel into the second annular channel, an outlet conduit extending at an acute angle from the second annular channel to receive the secondary fuel therefrom in a tangential direction, a second linear fuel conduit parallel to the first linear fuel conduit and extending from the second outlet conduit and communicating with a second injector inlet conduit at the fuel delivery outlet, the second injector inlet conduit being angled to direct the fuel flow to the secondary annular passage in the injector tip in a tangential direction to provide a swirl to the secondary fuel flow entering the secondary annular passage in the injector tip.

8. In the injector as defined in claim 6, wherein certain of the conduits include at least portions that have a cross-sectional diameter smaller than adjacent conduit portions in order to meter the fuel flow passing therethrough.

9. A fuel injector for use in a combustor of a gas turbine engine, whereby the combustor includes a combustor wall defining a combustion chamber surrounded by pressurized air, the injector comprising an injector tip adapted to protrude, when in use, through the combustor wall into the chamber, the injector tip having an injector body extending along an injector tip axis, a primary fuel nozzle formed in the injector tip concentrically of the injector tip axis and communicating with a primary fuel chamber formed as a cone upstream of the fuel nozzle and coaxial therewith, at least a first annular fuel channel defined in the injector body upstream of the primary fuel chamber concentric with the injector tip axis and communicating with the primary fuel chamber, a plurality of slots to communicate the primary fuel chamber, wherein the slots are angled to provide a tangential delivery of the fuel flow from the first annular channel to the primary fuel chamber, and means for providing a flow of pressurized fluid to the first annular channel tangentially thereof in order to provide a swirl to the fuel flow in the first annular fuel channel, the primary fuel chamber, and thus to the tip nozzle, thereby atomizing the fuel as it exits the primary fuel nozzle.

10. The fuel injector as defined in claim 9, wherein the slots are provided with portions of reduced diameter in order to provide for the metering of the fuel flow between the various annular passages.

11. A fuel injector for use in a combustor of a gas turbine engine, whereby the combustor includes a combustor wall defining a combustion chamber surrounded by pressurized air, the injector comprising an injector tip adapted to protrude, when in use, through the combustor wall into the chamber, the injector tip having an injector body extending along an injector tip axis, a primary fuel nozzle formed in the injector tip concentrically of the injector tip axis and communicating with a primary fuel chamber formed as a cone upstream of the fuel nozzle and coaxial therewith, at least a first annular fuel channel defined in the injector body upstream of the primary fuel chamber concentric with the injector tip axis and communicating with the primary fuel chamber, and means for providing a flow of pressurized fluid to the first annular channel tangentially thereof in order to provide a swirl to the fuel flow in the first annular fuel channel, the primary fuel chamber, and thus to the tip nozzle, thereby atomizing the fuel as it exits the primary fuel nozzle; a secondary fuel delivery arrangement is provided which is concentric and radially outward of the primary annular fuel channel, the secondary fuel delivery arrangement including a secondary annular fuel channel, a secondary annular conical fuel chamber provided concentrically and outwardly of the primary fuel chamber, a secondary fuel nozzle provided concentrically and outwardly of the primary fuel nozzle in the injector tip axis, secondary fuel inlet conduit for directing fuel under pressure tangentially into the secondary annular fuel channel in order to provide a swirl to the fuel flow in the secondary annular fuel channel, the secondary annular conical fuel chamber and the secondary fuel nozzle.

12. In the injector as defined in claim 11, wherein conduits are provided to communicate the secondary annular fuel channel with the secondary annular conical fuel chamber and the conduits include at least portions that have a cross-sectional diameter smaller than adjacent conduit portions in order to meter the fuel flow passing therethrough.

* * * * *